United States Patent [19]

Mintel et al.

[11] Patent Number: 4,794,674

[45] Date of Patent: Jan. 3, 1989

[54] RIB LOCK DEVICE

[75] Inventors: Thomas E. Mintel, Somerset; Kenneth W. Misevich, Piscataway, both of N.J.

[73] Assignee: Colgate-Palmolive Company, New York, N.Y.

[21] Appl. No.: 81,053

[22] Filed: Aug. 3, 1987

[51] Int. Cl.[4] ..... A43C 9/00

[52] U.S. Cl. ..... 24/143 R; 24/140

[58] Field of Search ..... 24/143 R, 143 A, 143 B, 24/140, 141, 68 SK, 69 SK, 71 SK, 20 EE, 16 PB; 36/50

[56] References Cited

U.S. PATENT DOCUMENTS

| | | | |
|---|---|---|---|
| 765,227 | 7/1904 | Cummings | 24/143 R |
| 782,604 | 2/1905 | Funk | 24/143 R |
| 2,618,036 | 11/1952 | Statham | 36/50 |
| 3,012,297 | 12/1961 | Wade | 24/16 PB |
| 3,263,292 | 8/1966 | Fekete | 24/16 PB |
| 3,418,733 | 12/1968 | Tyrrell, Sr.; et al. | 24/143 R |
| 3,654,049 | 4/1972 | Ausnit | 24/16 PB |
| 4,112,557 | 9/1978 | Salomon | 24/69 SK |
| 4,310,951 | 1/1982 | Riedel | 24/68 SK |
| 4,395,801 | 8/1983 | Gabrielli | 36/50 |
| 4,683,620 | 9/1987 | Valsecchi et al. | 24/68 SK |

FOREIGN PATENT DOCUMENTS

| | | | |
|---|---|---|---|
| 813963 | 9/1951 | Fed. Rep. of Germany | 24/143 R |
| 2005481 | 12/1969 | France | 24/68 SK |
| 91528 | 2/1958 | Norway | 24/140 |

*Primary Examiner*—Victor N. Sakran

*Attorney, Agent, or Firm*—Norman Blumenkopf

[57] ABSTRACT

A releasable fastening device for use in joining straps, laces, filaments and the like is disclosed. The fastening device may be used to join the laces or closure components of a shoe, for example, or in any of various devices in which filaments, straps and the like are advantageously bound in a quick release mechanism. The invention includes a pair of thin planar, elongated strips, each of which has a plurality of ribs positioned transversely along the length thereof. Each of the ribs has a planar side face positioned at an angle of about 45 to 75 degrees relative to the plane of the upper surface of the planar strip to which it is attached. The planar strips may be provided as part of the respective straps, laces or the like to be fastened. Alternatively, the ribs may be affixed to a separate strip and the strip then secured to a planar surface of the strap or lace. For optimal ease of engagement of the ribs of one strip with those of a second strip, the rear top surfaces of the ribs should be rounded or slightly relieved.

4 Claims, 1 Drawing Sheet

FIG. 1
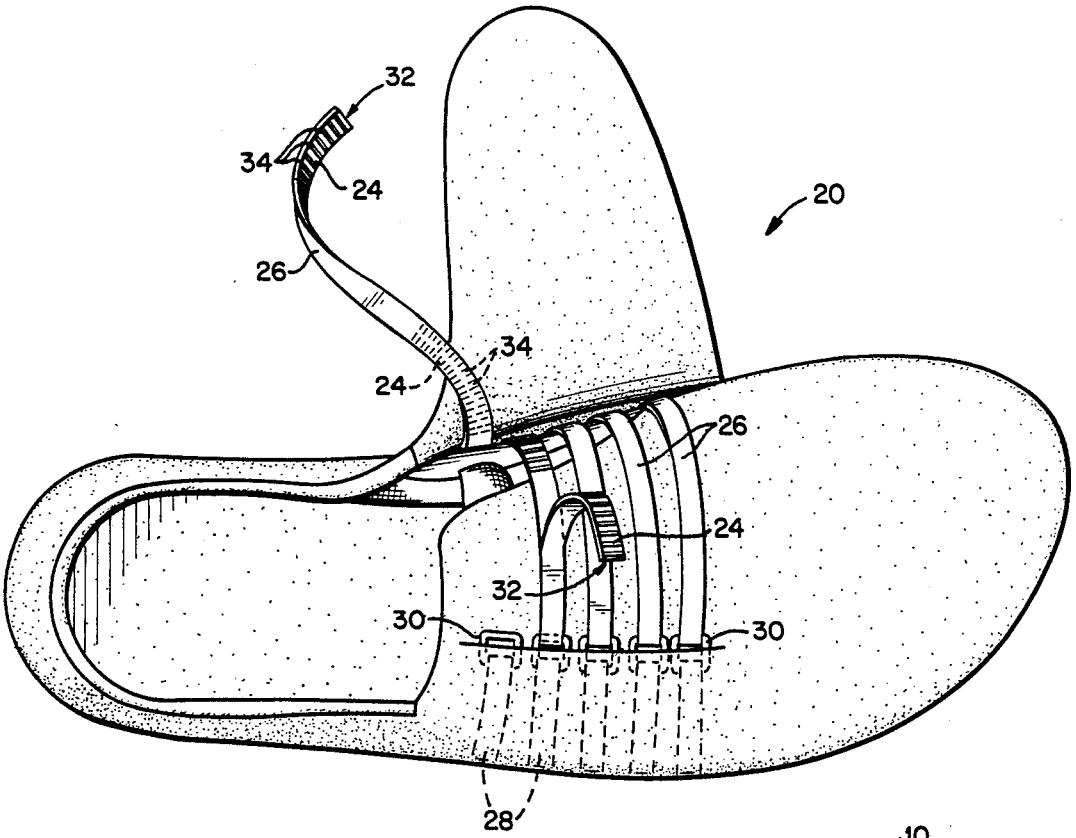
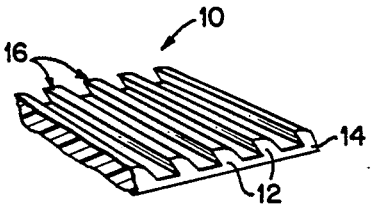
FIG. 2
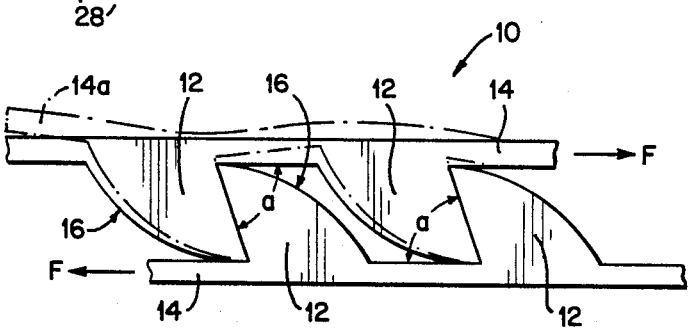
FIG. 3
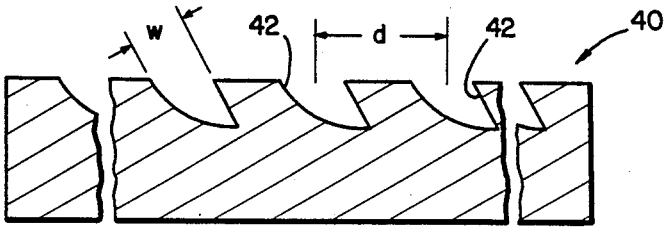
FIG. 4

RIB LOCK DEVICE

BACKGROUND AND SUMMARY OF THE INVENTION

The present invention relates to a fastener device. More particularly, the present invention relates to an improved construction for joining the straps, filaments or laces of a shoe construction.

Various types of devices for fastening or joining the laces or other closure components of a shoe are known in the art. Such closure devices include various types of buckles and interlocking components.

By the present invention, there is provided an improved fastener device for use in fastening the straps, filaments or laces of a shoe. The fastener device is in the form of a composite structure which, in one embodiment, includes a strong, thin, stiff planar strap material upon which are affixed a plurality of ribs arranged at an angle of approximately 60 degrees relative to the planar material. The ribs have an aspect ratio of about one and spacings between adjacent ribs are equal to or only slightly greater than the thickness of the ribs. For optimal ease of engagement, the rear top surfaces of the ribs should be rounded or slightly relieved. The present invention is not in any way limited to use with shoes and may be utilized in various types of devices in which filaments, straps, laces and the like are advantageously bound in a quick release mechanism.

According, it is an object of the present invention to provide a thin, non-slipping locking and fastening device for joining straps, laces, filaments and the like.

It is an additional object of the present invention to create a locking mechanism for the closure components of a shoe in which the locking mechanism can be as strong as the forces transmitted through the girthing straps in a shoe.

It is a further object of the present invention to provide a quick release closure mechanism which can be molded directly onto the strap of a closure device.

It is an additional object of the invention to provide the capability for adjusting a closure mechanism to fine, discrete locking lengths.

BRIEF DESCRIPTION OF THE DRAWINGS

FIG. 1 is a top plan view of a fastener device of the present invention installed in a shoe construction.

FIG. 2 is a perspective view of a segment of one of the locking members of the rib lock device of the present invention.

FIG. 3 is a side elevation showing two interlocking locking members in the rib lock fastener of the present invention.

FIG. 4 is a cross sectional view of a mold for producing the locking members of the present rib lock device.

DESCRIPTION OF THE PREFERRED EMBODIMENTS

In the embodiment of the invention as shown in FIGS. 1 through 4, there is provided a rib lock fastener device 10 having a plurality of transverse ribs 12 extending along the length thereof.

The present invention is in the form of a composite structure which, in one embodiment, is in the form of a strong, thin, stiff planar strap material 14 upon which are affixed a plurality of ribs 12 each of which has its planar side bearing surface angled at an angle "a" as shown in FIG. 3 of about 45 to 75 degrees relative to the plane of the upper surface of the material 14. In one embodiment, an angle of approximately 60 degrees was employed.

With regard to the rib angle "a" of the ribs 12 relative to the plane of the upper surface of the material 14, as the angle becomes smaller, assuming the aspect ratio and the force "F" on the structure remain constant, stresses build up in the device 10. In this regard, aspect ratio is defined as the ratio of the length of the planar mating surface of the rib to the base of the rib. Also, as the rib angle becomes smaller, it becomes increasingly more difficult to fit the components together. Conversely, as the angle becomes greater, the shearing forces increase.

If a soft material is employed for the ribs 12, a smaller rib angle will be required. If a stronger rib material is employed, larger rib angles can be effective. In the case of polyurethane ribs 12, for example, a rib angle of not more than 60 degrees is advantageously employed. In addition, the deflected shape of the device 10 cannot extend at an angle greater than 90 degrees or it will slip, as the ribs 12 from opposite straps 14 will shear with respect to each other and opposing ribs 12 will separate from each other.

The ribs 12 have an aspect ratio of about one and have spacings between ribs approximately equal to the thickness of the ribs in a direction parallel to the longitudinal axis of the strap 14. In one embodiment, the planar material is in the form of a strap having the ribs directly molded thereto to provide an integral, one-piece construction. In an alternative embodiment, the ribs 12 are individually affixed to a thin planar strip and the strip is then secured to a planar surface of a strap, lace or the like. The ribs 12 may also be individually affixed to the strap or lace.

Generally, the thickness of the ribs 12 will be proportional to the thickness of the planar strap portion 14. In this regard, the forces acting on the device 10 must not be so great as to cause the ribs 12 to separate from the ribs 12 of the opposing strap 14. Also, if bending around a radius, the straining forces must not be so great as to cause the ribs 12 to separate. To avoid this situation, the strap material 14 must be relatively thin and the ribs 12 must also be relatively thin.

When the forces are acting in one plane, the thickness of the material does not affect the bending strain imposed on the part. However, as the strap material is bent around a radius, the greater the degree of bending, the greater will be the necessity that the strap material be thinner in order to minimize the strain. Also, it is desirable that a smaller rib angle be employed under conditions of increased bending so as to provide a greater amount of tooth surface, thus compensating for the vertical forces tending to separate opposing ribs 12. Thus the bending forces imposed upon the device 10 are a function of the thickness and the radius of bending as well as the properties of the material.

For optimal engagement strength, the tops of the rib surfaces are parallel to the base plane, but for optimal ease of engagement, the rear top surface 16 of each rib 12 should be rounded or slightly relieved. Such a construction allows the ribs 12 to be raised and allowed to slide over each other. As shown in FIG. 3, the top surfaces 16 of adjacent ribs 12 from opposite straps 14 preferably do not contact each other when in the secured position.

Depending on the desired strength and detailed fastening function, the rib material could range from that of a soft elastomer to that of a hard thermoplastic or thermosetting material. Also, the strap and ribs of the fastener do not necessarily have to be of the same material. The strap may be formed of a material such as polyester or fiberglass, for example. In one embodiment, a ⅝ inch wide polyester ribbon was employed for each strap 14 and the ribs 12 were constructed of polyurethane in a segment one inch in length, thus providing ⅝ square inches of contact area for each strap 14.

By the use of a finite element stress analysis, the geometry of the ribs 12 has been determined for the present invention. The ribs 12 may be attached to or form part of any suitable surface, including a non-planar surface, so long as the ribs can be permanently adhered or molded to the supporting surface.

In one embodiment, the outer ends of the fastener straps are reinforced with a metal such as brass. In addition, the outer end portion may be curved downwardly so as to provide additional reinforcement at the ends and to maintain the end portions of the device 10 together during the application of longitudinal forces "F" as shown in FIG. 3. In another embodiment, a ring of plastic or similar material may be passed over the end portions of the rib lock device to maintain the engaged ribs in position and keep the end portions from moving outwardly away from engagement with the opposite strap.

The configuration of the strap end 14*a*, as shown in the dashed line position in FIG. 3, indicates the uplifted or deflected condition which can result when forces "F" act as shown, in the absence of reinforcement to maintain the strap end in a flat condition.

In FIG. 1 there is shown a shoe upper 20 having securing straps with the rib lock device 24 of the invention installed thereon. As shown in FIG. 1, the medial 26 and lateral 28 sling straps extend up and over the foot from their points of attachment to the outsole of the shoe. Each medial strap 26 passes through a buckle 30 fastened at the upper end of the corresponding lateral strap 28. The medial strap 26 is then folded back so that its outer end 32 may be secured to the outer surface of a portion of the strap 26 itself by the rib lock device 24 of the present invention.

The rib lock device 24 on each medial strap 26 includes a series of ribs 34 attached to the strap 26 itself as previously discussed.

The rib lock fastener device 10 may be advantageously employed for joining and fastening straps, laces and the like. In comparing the capabilities of the present fastener with a Velcro fastener having similar dimensions, it was found that a shear strength of 79 psi was obtained with the fastener of the present invention, whereas a shear strength of only 20 psi was obtained with the Velcro fastener. It was also found that a stiffness of 217 lbs./in. was obtained with the present fastener, whereas a stiffness of only 29 lbs./in. was obtained with the Velcro fastener. Thus the stiffness of the present fastener was an order of magnitude greater than that of the Velcro fastener.

The stiffness characteristics of the present fastener are particularly important in the use of the fastener with shoe laces. Conventional shoe laces are typically woven structures in which fiber alignment provides that large strains must be produced before a significant load can be handled. One typical shoe lace strained 5% but carried a load of only five pounds. While a shoe lace has a continually increasing modulus, it is more beneficial, with regard to the present invention, for the sling strap fibers to have a significant initial stiffness and remain stiff throughout the effective support range. Such a property allows significant forces to be supported at much lower strains. Thus there is established a "relative inextensibility" which is preferably a characteristic of the sling straps employed in the present invention.

In FIG. 4 there is shown a mold 40 for use in making a rib lock device 24 of the present invention wherein the strap and ribs are molded as an integral unit. In one embodiment, the mold 40 was in the form of a flat aluminum plate having a height of about ¼ inch and a length and width of about 3 inches by 2.36 inches. A total of twenty channels 42 could be employed in such a mold 40 for use in forming the ribs of the device, with the strip portion being formed above the mold 40 and cut to the desired size by means such as a mill blade. in this embodiment, the channels 42 had a width w measured perpendicular to the angled side walls of approximately 3/64 inch and with an interval d between the centers of the channels 42 of approximately 0.094 inch. The height of the channels 42 measured perpendicular to the upper surface of the mold 40 was approximately 0.041 inch in this embodiment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Fastener means for preventing relative longitudinal movement of a pair of strap structures in one direction comprising a plurality of identical ribs on each of said strap structures, each of said ribs extending across said strap structures from side to side thereof, said ribs each having a flat front face extending at an angle of about 45° to 75° with respect to said strap structures, each of said ribs having an arcuate rear face, the spacing between said ribs being such that when said ribs are interlocked with their flat front faces in locking engagement the respective rear faces are spaced apart to facilitate engagement and disengagement of said ribs.

2. The fastener means of claim 1 wherein said ribs are formed integrally with said strap structures.

3. The fastener means according to claim 1 wherein said strap structures comprise longitudinally spaced portions of a single strap.

4. A fastener strap for a shoe, said shoe having a lateral strap terminating in a buckle, said fastener strap adapted to extend from one side of said shoe over the top thereof through the buckle and be folded back on itself in a predetermined tensioned position, means for retaining said strap in said predetermined folded position comprising a plurality of identical ribs extending across said strap, each of said ribs having a flat face extending at an angle of about 45° to 75° with respect to the body of said strap and an arcuate rear face, the spacing between said ribs being such that when said strap occupies said predetermined foled position and said flat front faces of said ribs are in locking engagement the respective arcuate rear faces are spaced apart to facilitate the engagement and disengagement of said ribs.

* * * * *